US008789450B2

(12) United States Patent
Scherl

(10) Patent No.: US 8,789,450 B2
(45) Date of Patent: Jul. 29, 2014

(54) WOOD WORKING MACHINE AND SUITABLE RIP FENCE MODULE

(75) Inventor: Thomas Scherl, Ulm (DE)

(73) Assignee: Scheppach Fabrikation von Holzbearbeitungsmaschinen GmbH, Ichenhausen (DE)

( * ) Notice: Subject to any disclaimer, the term of this patent is extended or adjusted under 35 U.S.C. 154(b) by 687 days.

(21) Appl. No.: 12/923,236

(22) Filed: Sep. 10, 2010

(65) Prior Publication Data

US 2011/0061508 A1 Mar. 17, 2011

(30) Foreign Application Priority Data

Sep. 12, 2009 (EP) ..... 09400046

(51) Int. Cl.
*B27B 27/10* (2006.01)

(52) U.S. Cl.
USPC ..... 83/446; 83/477.2

(58) Field of Classification Search
USPC ..... 83/446, 477.2
IPC ..... B27B 27/02,27/10
See application file for complete search history.

(56) References Cited

U.S. PATENT DOCUMENTS

| | | | | | |
|---|---|---|---|---|---|
| 2,166,703 | A * | 7/1939 | Boice | 83/438 |
| 2,808,084 | A * | 10/1957 | Eschenburg et al. | 83/438 |
| 3,389,625 | A * | 6/1968 | Wagner | 82/122 |
| 4,206,910 | A * | 6/1980 | Biesemeyer | 269/236 |
| 4,322,066 | A * | 3/1982 | Disney | 269/304 |
| 4,516,612 | A | 5/1985 | Wiley | |
| 4,566,510 | A * | 1/1986 | Bartlett et al. | 144/48.3 |
| 4,600,184 | A * | 7/1986 | Ashworth | 269/303 |
| 4,607,893 | A * | 8/1986 | Damico | 384/45 |
| 5,181,446 | A * | 1/1993 | Theising | 83/438 |
| 5,439,294 | A * | 8/1995 | Rixen et al. | 384/45 |
| 6,360,641 | B1 * | 3/2002 | Talesky et al. | 83/438 |
| 6,675,685 | B2 * | 1/2004 | Ceroll et al. | 83/438 |
| 7,444,913 | B2 * | 11/2008 | Shibata et al. | 83/446 |
| 7,497,239 | B2 * | 3/2009 | Smith | 144/286.5 |
| 7,574,949 | B2 * | 8/2009 | Hadaway et al. | 83/446 |
| 2004/0123712 | A1 | 7/2004 | Dick | |
| 2010/0071521 | A1 * | 3/2010 | Hadaway et al. | 83/76.1 |

FOREIGN PATENT DOCUMENTS

DE 93 07 673 U1 9/1993

OTHER PUBLICATIONS

European Search Report corresponding to EP 09 40 0046, Mar. 10, 2003.

* cited by examiner

*Primary Examiner* — Kenneth E. Peterson
(74) *Attorney, Agent, or Firm* — Bacon & Thomas, PLLC

(57) ABSTRACT

A rip fence module for positioning workpieces with their edge facing away from a tool on a machine table at a certain distance to the tool, comprising: a superstructure overlapping the machine table presenting a workpiece stop for the workpiece to be treated extending in a longitudinal direction, at least one guided portion which is insertable and guidable in an allocated guide groove provided on the machine table side extending in an extension direction transversely to the longitudinal direction, and by which the superstructure is supported movably in the guide groove in the extension direction relatively the tool, and a locking device shiftable between a locking position and a release position in order to lock the rip fence module in the locking position at a guided portion defined relatively the guide groove, and to permit in the release position a shifting of the guided portion in the guide groove.

15 Claims, 10 Drawing Sheets

WOOD WORKING MACHINE AND SUITABLE RIP FENCE MODULE

Figure 1:
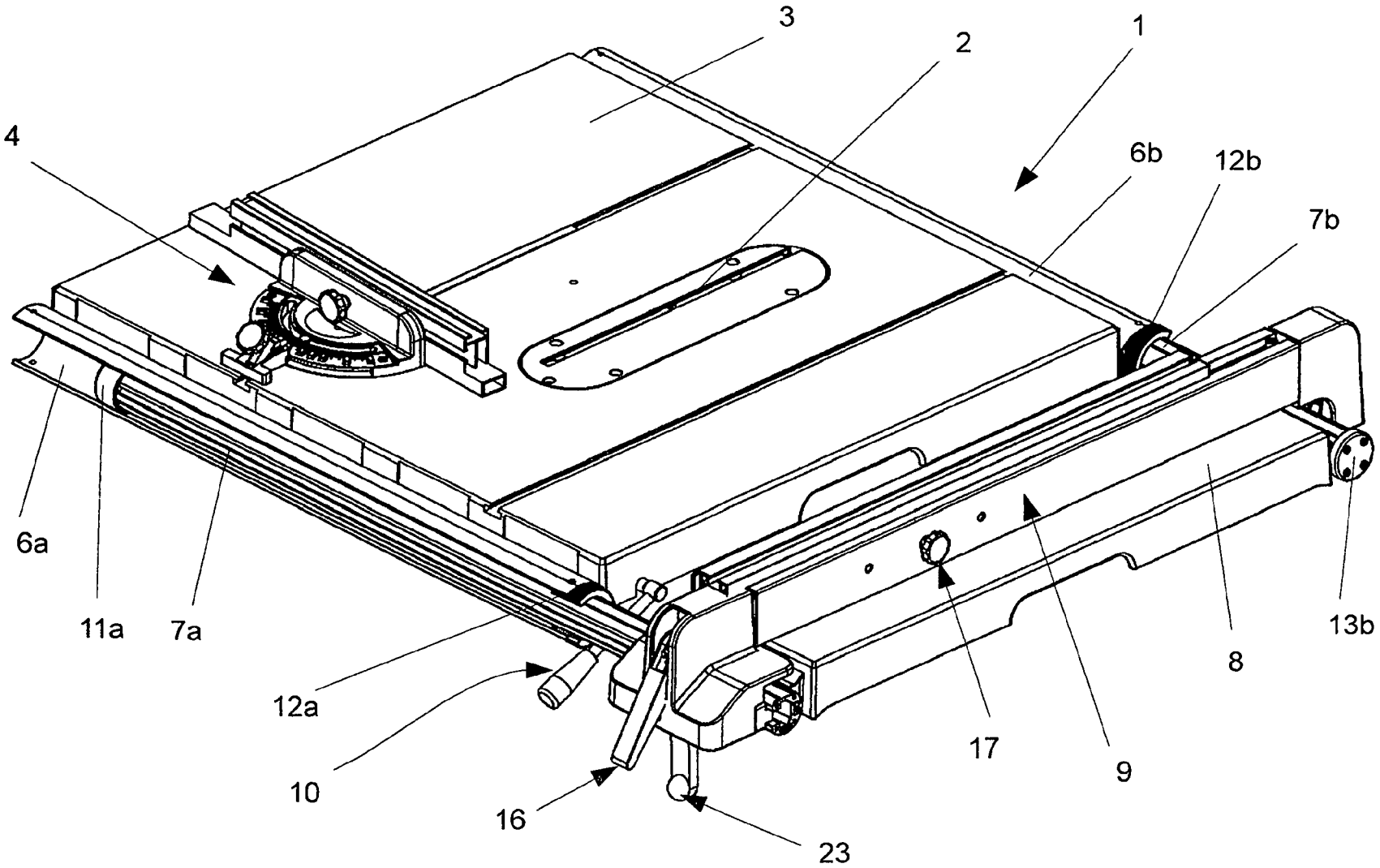

The invention relates to a rip fence module, such as for a wood working machine.

In the case of machine tools, in particular wood working machines such as circular saws or the like often workpieces such as for example chipboards must be lead past a tool passing through a machine table such as for example a saw blade or disk (in the case of a circular saw).

Therefore, such machine tools often have a rip fence movable on the machine table opposite to (what means relatively to) the tool in a extension direction extending transversely to a longitudinal direction, for example the working direction of a saw blade or disk, the rip fence having a workpiece stop in parallel to the longitudinal direction to which the workpiece can be abutted in order to be positioned on the machine table with a specific distance to the tool with its edge faced away from the tool in order to be then lead past the tool. In order to firmly adjust the adjusted distance of the rip fence of the tool during the following working operation, generic machine tools and/or their rip fence module moreover present a locking device, which is shiftable by an operator between a locking position and a release position in order to arrest a guided portion of the rip fence or release it for readjustment of the distance between the tool and the workpiece stop.

In the printed US patent specification U.S. Pat. No. 4,322,066, for example, a circular saw with a roller-guided rip fence module has been proposed in order to improve sliding of the guided rip fence. The guided section of the rip fence encloses in an U-shaped manner a guide rib attached on an end table. In the groove base and on a flank of the U-shaped portion, rollers are attached over which the rip fence can roll off on the guide rib. Moreover, the rip fence module comprises a locking device having an arm formed as a fork, which encompasses a screw, which can be pressed against or releases a guide rib held in the groove between the branches of the guided portion.

In the wood working field, guide rails and/or suitable accommodations for rip fence modules exist already on common machine tables so that suitable rip fences can be sold also as rip fence modules which can be bought individually in addition.

The workpiece stop is provided here on a superstructure of the rip fence overlapping the machine table at least partially with the superstructure being shiftably accommodated on the machine table in at least one guide groove provided for it via at least one guided portion.

Rip fences are known, which entirely overlap the machine table, and are supported on the machine table in a guide groove on the front and rear side. Other known rip fences are supported by means of a guided portion in a guide groove provided on a front side of the machine table and on the rear side of the machine table via a sliding support on the surface of the table top.

A modification is shown in US patent application US 2004/0123712 A1 where a circular saw with a rip fence module is provided which can be driven via a motor and a spindle located alongside the machine table. For this purpose, the rip fence is received on the spindle with a corresponding nut, with the nut being located on a guided portion which is received together with the motor spindle in a guide groove, the guided portion and/or the guided carriage with one arm passing through the guide rail profile, with the arm being connected with the superstructure of the rip fence by means of a clamp and guided with a guiding piece on a T-shaped guide rail end of the guide rail profile.

In both variants it frequently happens that the rip fence gets jammed in the allocated guides provided on the machine table.

It is therefore an objective of the present invention, to create a smooth-running rip fence, and a wood working machine with a smooth-running rip fence which can rapidly and easily be attached to and removed from the machine table.

According to the invention the guided portion of the rip fence module and/or the rip fence of the wood working machine by means of which the superstructure of the rip fence is movably supported in a guide groove provided on the machine table, presents one or several guided carriages, which can be inserted into the guide groove at least in sections, presenting in turn each a number of ball bearings or roller bearings and/or rollers with ball bearings or roller bearings via which each guided carriage inserted into the guide groove can roll off on allocated rolling surfaces of the guide groove in release position and/or via which each guided carriage is movable on rollers in the guide groove in extension direction and contrary to the extension direction, with the guided carriage having moreover a carriage body on the superstructure, on which the number of ball bearings or roller bearings (and/or the rollers) is accommodated on the guide groove with an alterable and/or adjustable distance to the allocated roll-off surface (what means roll way surface) preferably in vertical direction between a roll-off position and a withdrawal position. In roll-off position (what means rollable position) the number of ball bearings or roller bearings abuts the guiding surfaces and does not abut the guiding surfaces in the withdrawal position serving for withdrawal of the guided carriage from the guide groove.

Thus, not only a smooth-running shifting of the rip fence against the tool is possible, which is not only a benefit to precise adjustment of the desired distance between the tool and the workpiece stop whereby the rip fence does not so easily get jammed either as is the case in rip fence modules with sliding guidance.

Rather the guided carriage in the withdrawal position can particularly easily be inserted into the guide groove with its rollers so that in total the rip fence can be easily attached to the machine table. Prior to putting the rip fence into operation, the ball or roller bearings are then brought into their roll-off position abutting the guide rail in their allocated roll-off surfaces free of clearance extending in extension direction. When the rip fence module is to be removed from the machine table, the ball or roller bearings (and/or rollers) are brought again from their roll-off position abutting the allocated roll-off surfaces into the non-abutting withdrawal position. Subsequently, the guided carriage can again easily be removed from the groove and the rip fence module can be withdrawn from the machine table.

The number of ball or roller bearings can, for example, be fixed to the carriage body via an arm arrangement movable preferably in vertical direction and/or spreadable or pivotable in this direction. The withdrawal position then corresponds to a position of the arm arrangement in which the number of ball or roller bearings is not spread vertically to the extension direction against the run-off surfaces. A spread position of the arm arrangement in the guide groove then corresponds to the roll-off position.

More preferably a preloading device is provided, which preloads the ball or roller bearings into the roll-off position, preferably a preloading device engaging in the arm arrangement and preloading the arm arrangement in the spread position, the roll-off position, so that the bearings inserted into the guide groove are preloaded against the roll-off surfaces of the guide groove allocated to them.

In total, thus a precise guidance of the rip fence in the guide groove without sputtering during shifting is achieved.

Of course, in a guide groove provided on the front side of the machine table and a guide groove provided on the rear side of the machine table, a guided carriage supported by ball bearings or roller bearings can be provided in both guide grooves each via a rip fence supported by a guided portion. It is also imaginable to movably receive the rip fence on the machine table via a plurality of guided carriages supported by roller or ball bearings in a guide groove. In the case of a rip fence, which is only received in a guide groove on the front side of the machine table, and glides off on the rear side of the machine table via a sliding portion on the table top, however, only a guided carriage received in the guide groove on the front side is necessary. But for further improvement of smooth-running of the rip fence it would be imaginable to support the rip fence also here via a roller instead of the sliding portion on the rear side.

A wood working machine according to an advantageous further embodiment of the invention moreover comprises a table widening with an extension element presenting an extension plate for widening the machine table, which can be placed next to the machine table, the extension plate being received between two extension arms fixed to the extension plate, with the arms being received in two guide rails, which can be fixed on the table and are guided in extension direction, with at least the front extension arm being penetrated by a guide groove for the guided portion of the rip fence.

Thus, the fence cannot only be used in the extended condition of the table widening and in the retracted condition of the table widening but also the distance of the rip fence and/or the workpiece stop of the rip fence of the workpiece can be adjusted independent of the condition of extension of the table widening. Moreover, via the optional table widening a two-stage adjustment of the distance between the workpiece stop and the workpiece can be achieved: at first the table widening is coarsely put into the correct position with the rip fence locked in the guide groove(s) on the guide arm(s). Subsequently, fine adjustment of the distance of the workpiece stop to the tool is made via the guided carriage of the rip fence smoothly movable in the guide groove (after the locking device of the rip fence has been released).

For manual modification of the distance of the number of rollers to the allocated roll-off surfaces and/or for manual take off of the number of rollers for removal of the guided carriage out of the guide groove, an adjusting lever can be provided which is coupled with the arm arrangement via a coupling device. By the fact that a separate handle and/or adjusting lever for spreading and/or retraction of the arm arrangement is provided, for removal of the rip fence from the machine table, intentional unlocking on this adjusting lever has to be made, i.e. the number of rollers must be put into the withdrawal position, where they do not abut the allocated roll-off surface.

The arm arrangement may have an arm here, the end of which is pivotably attached to the carriage body around an axis of rotation extending in longitudinal direction, and the other end of which bears at least one roller. If the roller is pivoted upwards via the adjusting lever and the coupling device, for example, a coupling pin penetrating the carriage body and connected or connectable with the adjusting lever, the roller can be put from the roll-off position, in which the carriage body and thus the rip fence is supported on it, into the withdrawal position with the superstructure of the rip fence module, for example, bearing here on the table top of the machine table.

Preferably, the arm arrangement, however, comprises a rocker preferably attached pivotable on the carriage body around an axis of rotation extending in longitudinal direction with two bearing bolts fixed on two opposite sides of the rocker with at least one roller being received on the bearing bolts. The carriage body can then be supported in the guide groove in the roll-off position via the arm arrangement and the rollers between an upper and a lower roll-off surface. As a result, the rip fence is not only especially safe but due to the relief of the lower roller also guided particularly smoothly. In theory, also a support between two vertically extending side walls of the guide groove would be imaginable here.

According to a further advantageous embodiment, the locking device comprises a contact pressure strip receivable in the respective guide groove, hence for example in a guide groove on the front side of the machine table facing towards the operator. Here, the contact pressure strip can be shifted via a coupling device engaging into the guide groove in longitudinal direction between the locking position, in which it is pressed against the rear side of an undercut of the guide groove extending in extension direction, and the release position, in which it is lifted off the rear side of the undercut. Moreover, the locking device can comprise a counter-retaining surface, which is pressed against a bearing surface on the machine table, when the contact pressure strip is moved into the locking position so that a counter-retaining force is created against the compressive force exercised via the contact pressure strip whereby locking of the rip fence occurs. Preferably, a contact pressure surface located on the contact pressure strip and the counter-retaining surface extend in another, preferably vertical plane to the run-off and/or roll-off surfaces for the roller (bearings) so that actuation of the locking device is possible entirely independent of adjustment of the guidance of the rip fence and/or putting of the arm arrangement into the withdrawal position or the guided position.

When the counter-retaining surface is located on the carriage body and the bearing surface is located on the guide rail on the front side opposite the rear side of the undercut, the rip fence can be locked or released for shifting by shifting of the contact pressure strip relative to the carriage body. Therefore it is advantageous, if the contact pressure strip is shiftable in longitudinal direction relative to the carriage body via the coupling device. Thus, a reliable and easily manageable locking and/or release of the rip fence in extension direction is possible.

A further advantageous embodiment of the invention relates to a pivoted lever received pivotable on the superstructure which is provided as an operating device for the locking device. The pivoted lever can be pivoted here between the release position and the locking position around a preferably horizontal pivot axis extending, for example, in extension direction, and comprises at least a guided portion extending eccentrically to its pivot axis via which the locking device is shiftable, thus operable between a locking position and the release position. At the same time, the above mentioned coupling device can be advantageously coupled with the pivoted lever via its guided portion extending eccentrically to the pivot axis.

Alternatively or in addition to locking of the rip fence by means of a locking device engaged on the front guide groove, the superstructure of the rip fence module can be formed as a portal superstructure entirely overlapping the machine table in longitudinal direction comprising on its rear side of the machine table facing away from the operator a clamping spigot, which can be pressed into an allocated guide groove provided on the machine side via the operating device, hence preferably via the pivoted lever, which corresponds to the locking position, and which moreover can be put into the release position movable transversely to the longitudinal direction. In order to press the clamping spigot into the locking position and/or into the allocated guide groove and/or to brace the clamping spigot in this position against another clamping device on the front of the machine table, for example, a bearing surface on the guide groove of the front side, a tension rod overlapping the superstructure in longitudinal direction may be provided, which—like the coupling of the coupling device—can be received in an eccentric guided portion on the pivoted lever. Via a pivoting of the pivoted lever abutting the superstructure by means of an external perimeter clamping surface on an allocated bearing surface, hence the tension rod can be put under traction or pressure so that the clamping spigot can be clamped against the bearing surfaces in the allocated guide groove, hence locked in the guide groove, and can also be unloaded, hence released again.

The locking device can comprise counter-stop surfaces on the front side of the machine table, which are pressed against corresponding bearing surfaces on the machine table, when the clamping spigot and/or the contact pressure strip are moved into the locking position. When releasing the locking via the pivoted lever provided as an operating device for the locking device, the rip fence can then be withdrawn in total from the machine (when simultaneously the bearings are located in a removable manner) so that an easy assembly and disassembly of the rip fence is possible.

In order to provide a high protection against displacement of the rip fence also in the case of lateral pressure of the workpiece, a combination of the clamping spigot with a further embodiment of the invention described above with a contact pressure strip received in a guide groove provided on the front side of the machine table proves to be particularly advantageous. Moreover, fixing of the rip fence on both sides of the machine table permits a high angular accuracy to the longitudinal direction, hence, for example, to a saw blade provided as a tool. If the contact pressure strip (for example via the coupling device) is likewise connected with the pivoted lever of the locking device, also in this embodiment the locking can be released and locked again with a flick of the wrist.

The adjusting lever for removal of the number of rollers from the allocated roll-off surfaces can be advantageously coupled with the arm arrangement via the same coupling device as the pivoted lever for actuating the locking device. For this purpose, the coupling device may comprise a coupling pin received pivotable in the carriage body and extending in longitudinal direction, on the side of which facing towards the guide groove on the one hand the arm arrangement and/or the rocker is received in a pivoted manner, and on which on the other hand the contact pressure strip is fixed, preferably on the free ends of the bearing bolt on which the rollers on the rocker are received.

The adjusting lever placed on the side of the carriage body facing away from the rocker may present a rod eye clevis portion penetrated by the coupling pin and non-rotatably connected with the coupling pin with which it connects to the carriage body on its side facing towards the rocker. On the side of the rod eye clevis portion facing away from the rocker and/or the carriage body a coupling section coupling the coupling pin with an operating device of the locking device can then be provided on the rear side via which the coupling pin is shiftable between the locking position, in which it is extracted so far from the guide groove that the contact pressure strip abuts the rear side of the undercut, and the release position, in which it is inserted so far into the guide groove that the contact pressure strip abuts the rear side of the undercut.

Another advantageous embodiment relates to the fixing of an angle bar forming a workpiece stop by means of an angle bar clamping device on the superstructure, preferably on a carrier section of the superstructure attached between a front and a rear frame. The angle bar can be clamped here by means of an angle bar clamping device and can be released for shifting in longitudinal direction. Advantageously the angle bar comprises an undercut groove extending in longitudinal direction and the angle bar clamping device comprises a contact pressure strip received in the undercut groove as well as a clamping screw with a bias spring—penetrating the carrier section and screwed with the contact pressure strip—by means of which the contact pressure strip is preloaded away from the carrier section.

For releasing and fixing again the angle bar after a shifting in longitudinal direction, only a flick of the wrist is necessary in order to fasten the clamping screw, if a hand-wheel is attached on the end of the clamping screw facing away from the contact pressure strip. Moreover, by means of the bias spring placed preferably around the clamping screw, the contact pressure strip in the groove of the angle bar is always maintained at a distance as soon as the clamping screw is released, whereby an easier moving of the angle bar onto the contact pressure strip and thus shorter assembly and disassembly times are possible.

The features of further dependent claims relate to the precise embodiment of the functional inventive idea with structural features which are explained more in detail in connection with the explanation of preferred embodiments of the invention by means of the attached drawings.

It is to be mentioned here that the features of the embodiments shall be included in the main claims of the invention not only in the combination precisely shown and explained but also in any other combination appearing to be reasonable. Moreover, it is pointed out that the structure of the guided carriage can also be employed in an advantageous manner, if on its carriage body instead of the ball or roller bearings or rollers sliding portions are provided. A rip fence module with the features of the preamble of claim 1 and the features of the guided carriage with ball bearings and/or sliding portions being provided movably on the carriage body, and/or a corresponding wood working machine and a carriage body constructed accordingly could therefore—optionally together with the features mentioned in the description above, the features mentioned in further dependent claims, and further features described in connection with the drawings in any reasonable combination—constitute alternative embodiments. It is likewise imaginable to make the structure of the locking device together with the features of the table fence and wood working machine in particular together with the other optional features concerning the structure of the locking device and its coupling to the guided portion as further embodiments.

Figure 2:
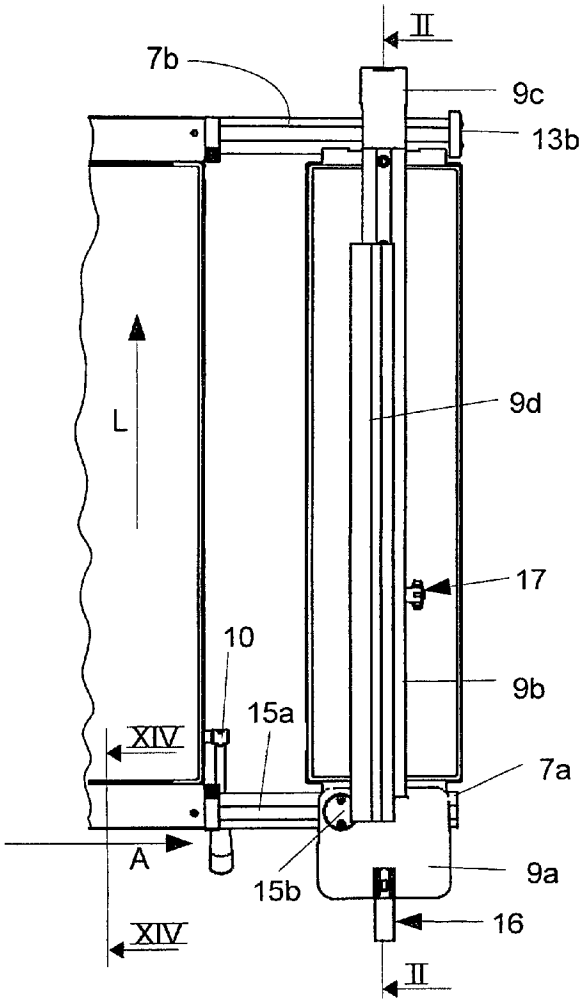
Figure 3:
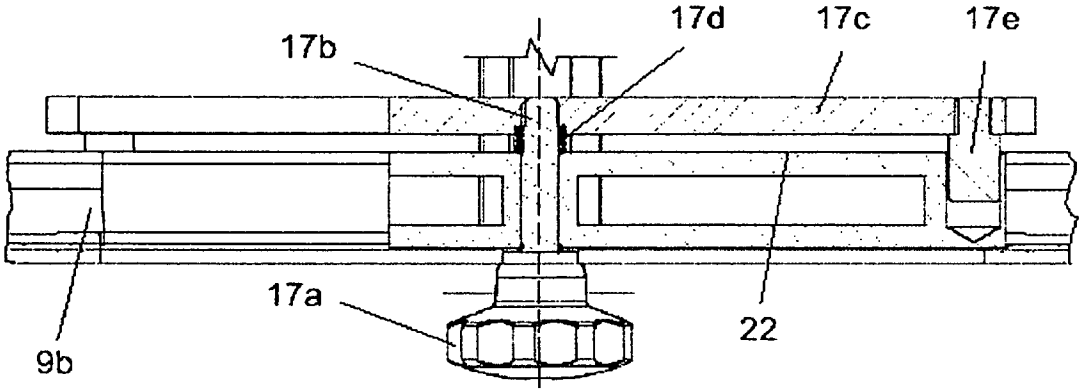
Figure 4:
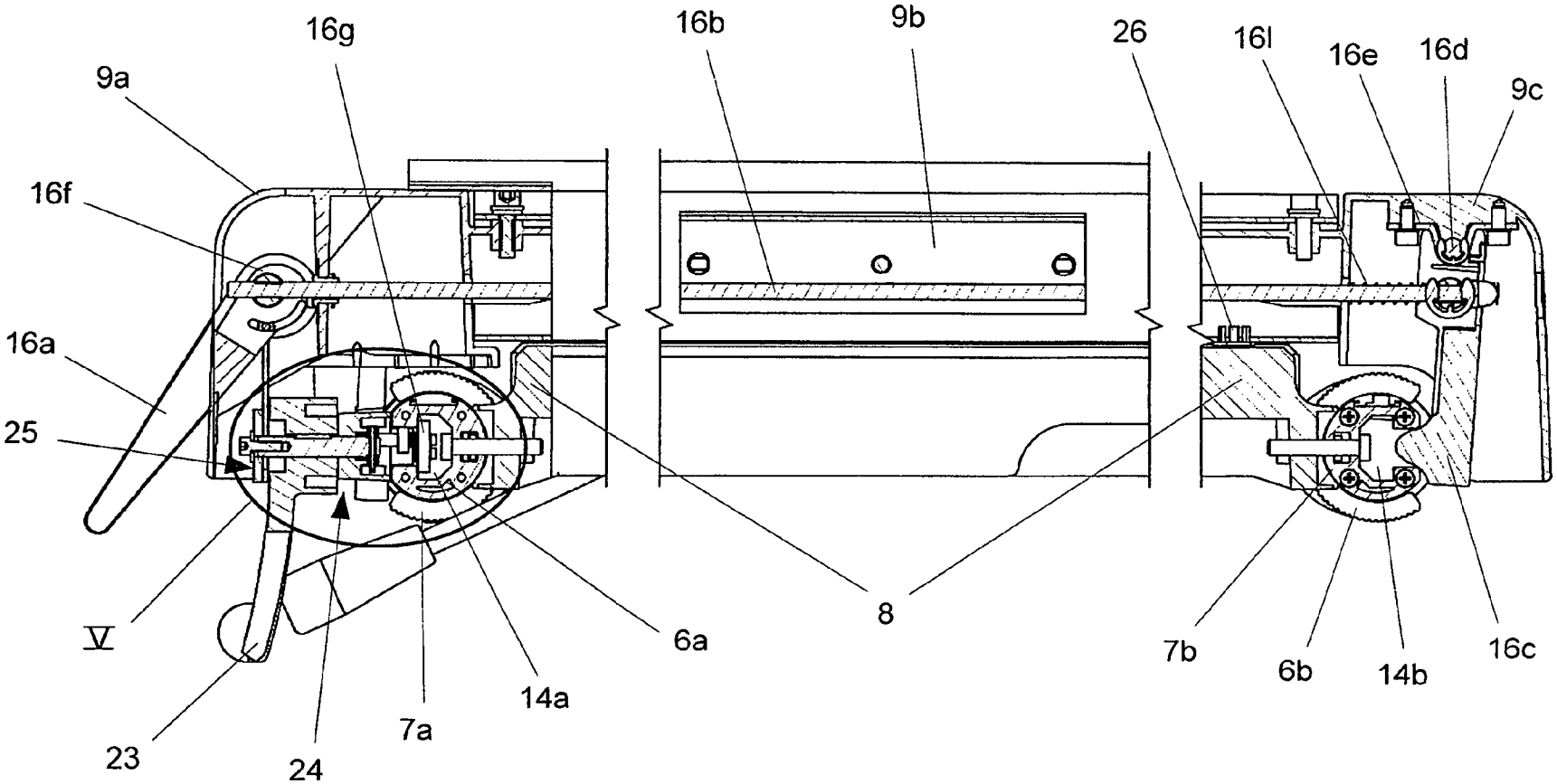
Figure 5:
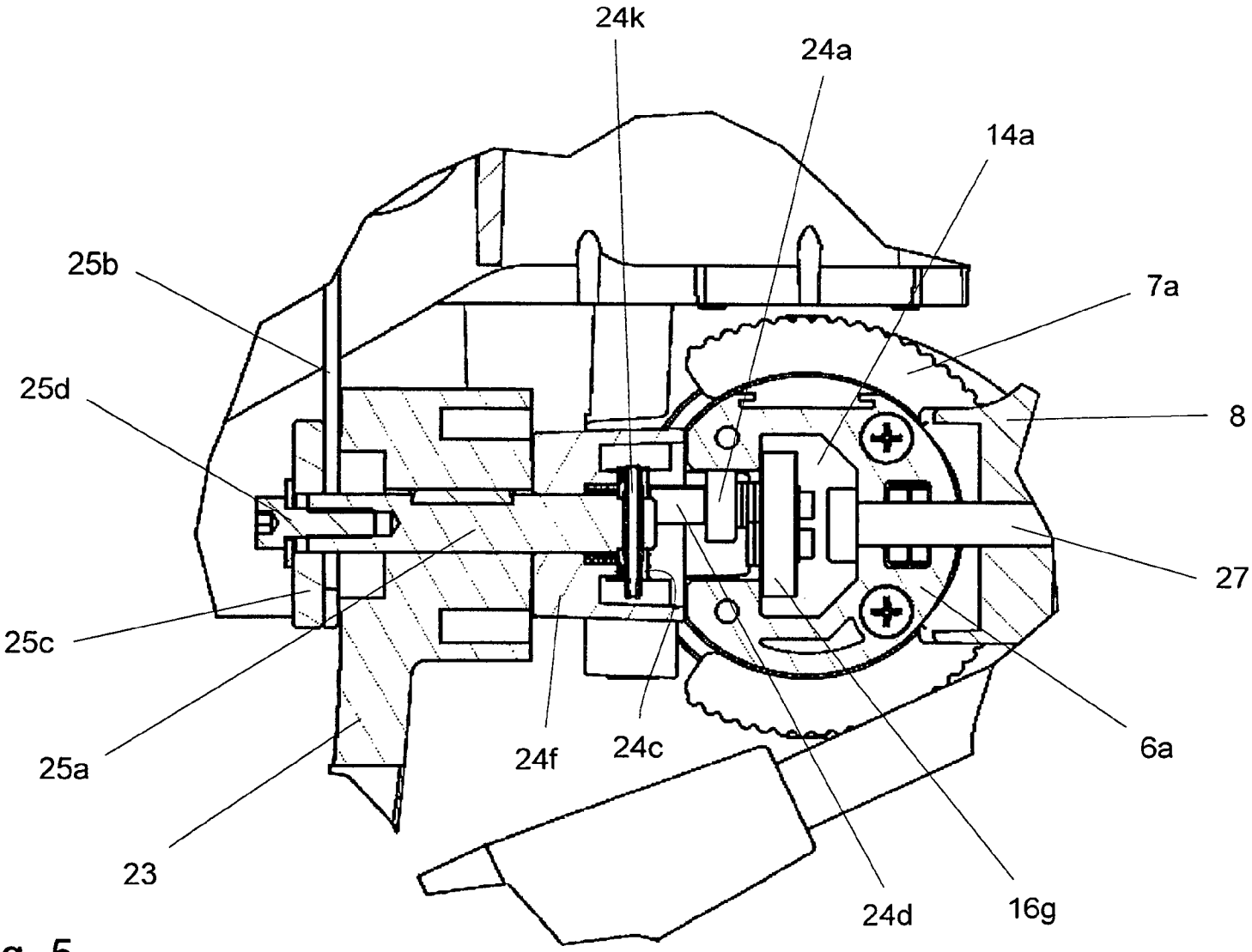
Figure 6:
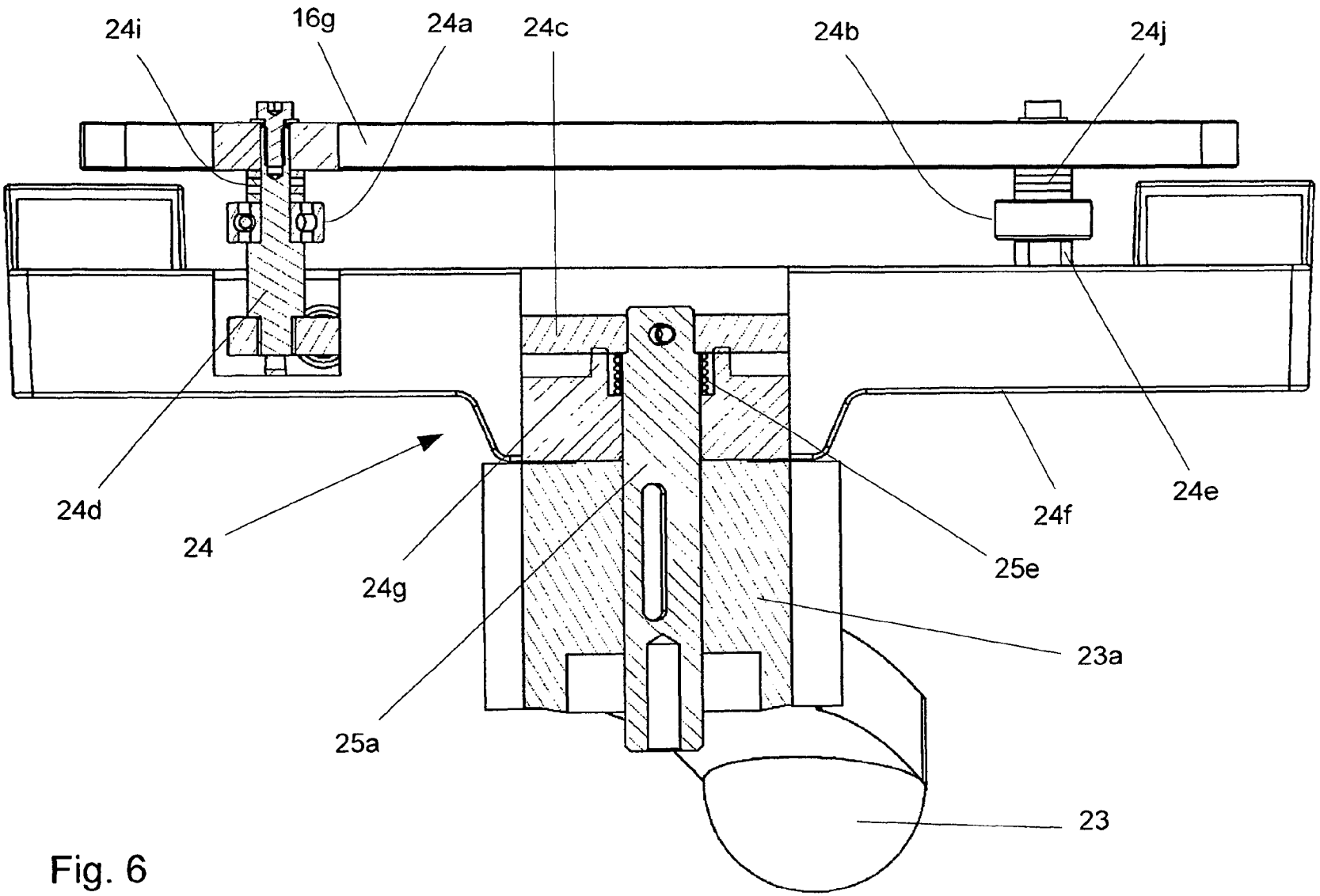
Figure 7:
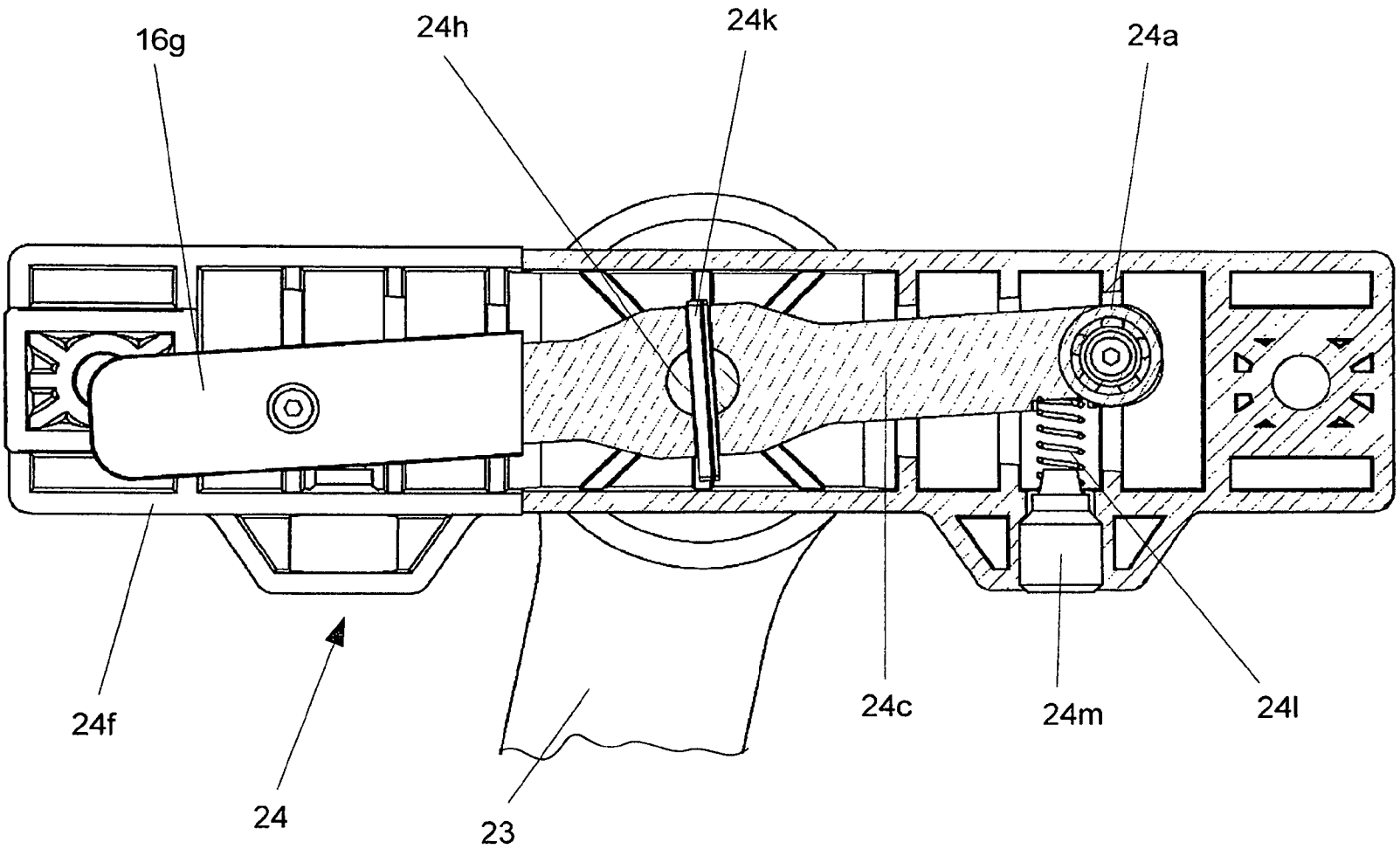
Figure 9:
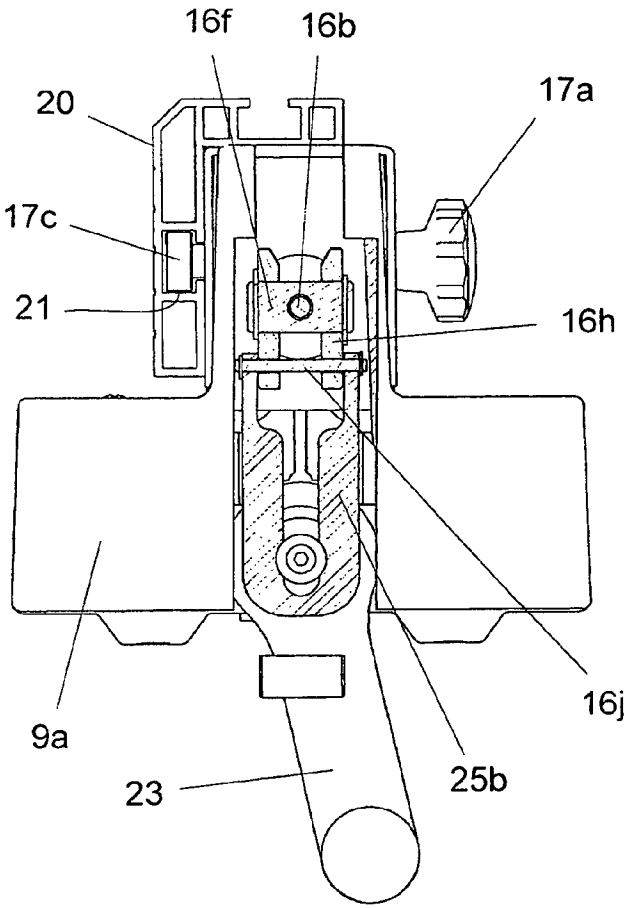
Figure 8:
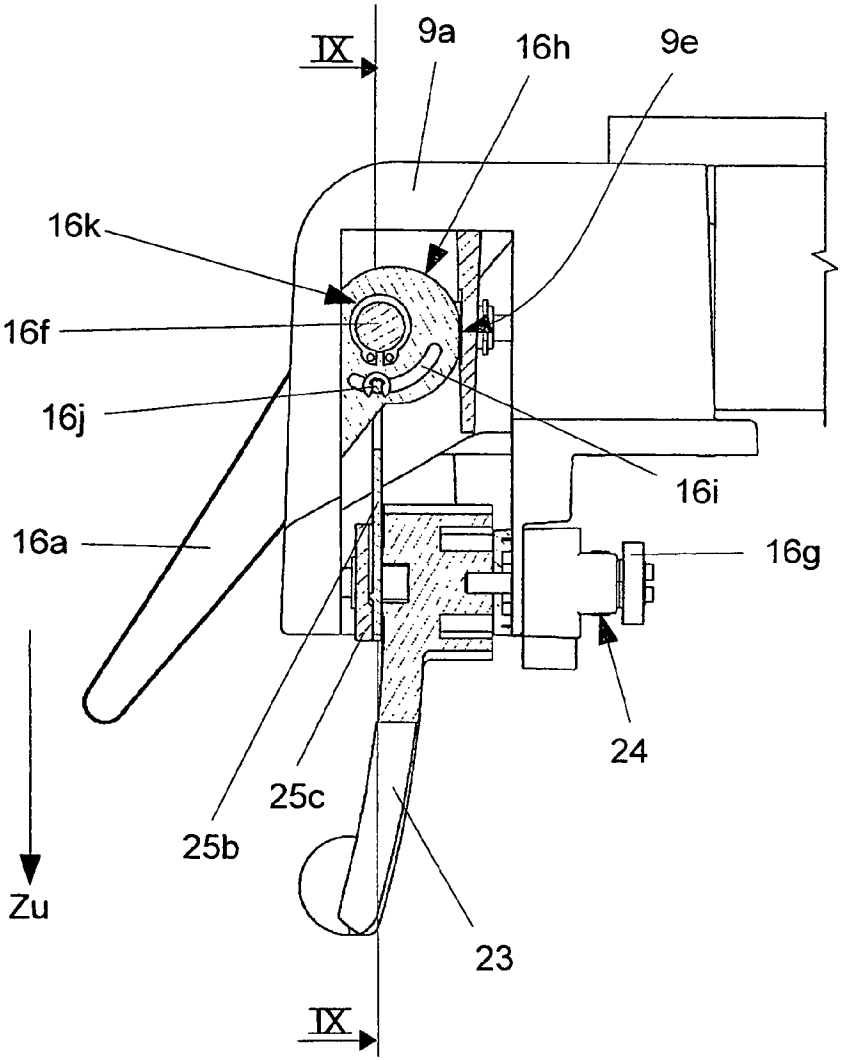
Figure 10A:
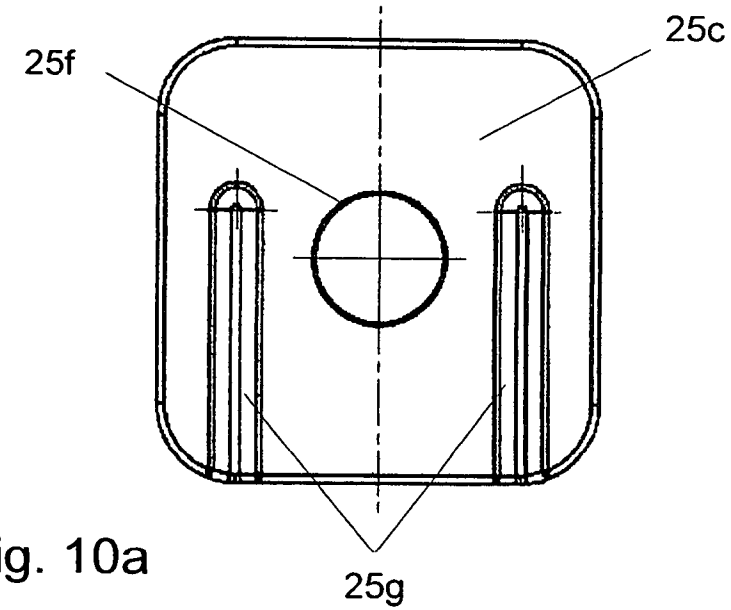
Figure 10B:
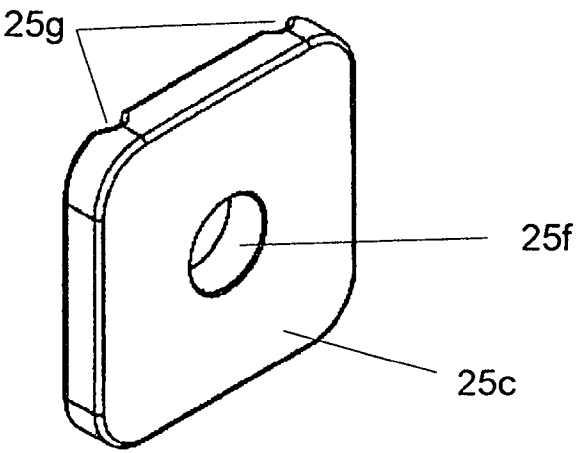

The drawings show:

FIG. 1 a perspective view of a machine table of a circular saw with a rip fence module according to a preferred embodiment of the invention;

FIG. 2 a partial plan view of the circular saw shown in FIG. 1;

FIG. 3 a partial view of the guide rail arrangement for the rip fence module used shown in FIGS. 1 and 2 of the embodiment of the invention;

FIG. 4 a section of the rip fence module shown in FIGS. 1 and 2 alongside line II-II in FIG. 2;

FIG. 5 detail V in FIG. 4;

FIG. 6 a detailed view of a guided carriage of the rip fence module shown in the previous figures from the top;

FIG. 7 another detailed view of the guided carriage in a partial sectional view from the side;

FIG. 8 a partially cut-out view of the section on the operator's side of the rip fence module shown in the previous figures from a side corresponding to FIG. 4;

FIG. 9 a sectional view alongside line IX-IX in FIG. 8;

FIG. 10*a* a side view of a washer of a coupling between a locking device and a bearing clearance adjusting device of the rip fence module shown in the preceding figures;

FIG. 10*b* a perspective view of the washer shown in FIG. 10*a;*

Figure 11:
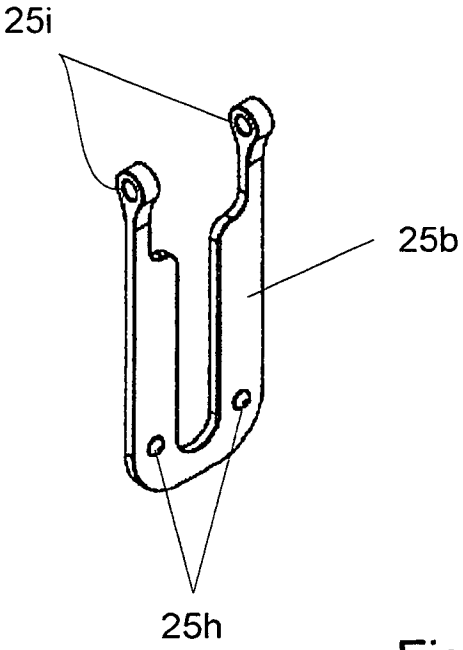

FIG. 11 a perspective view of a forked sleeve of the coupling allocated to the washer shown in FIGS. 10*a* and 10*b;*

Figure 14:
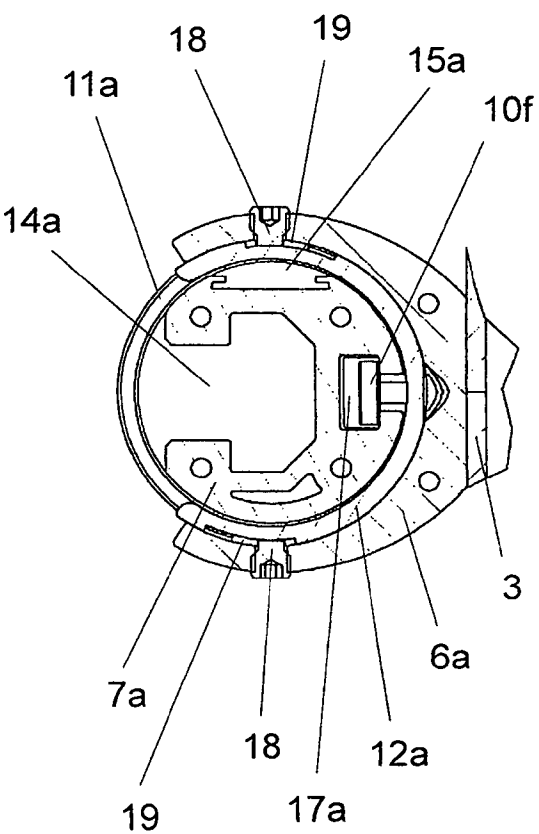
Figure 13:
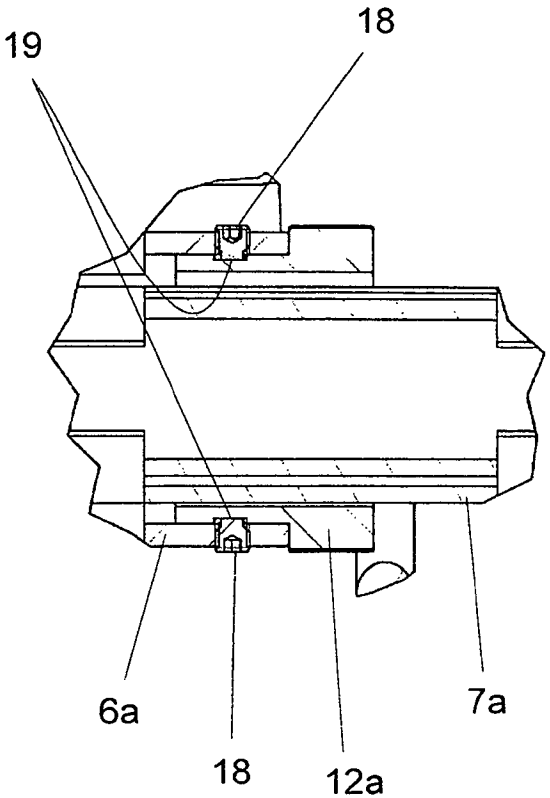
Figure 12:
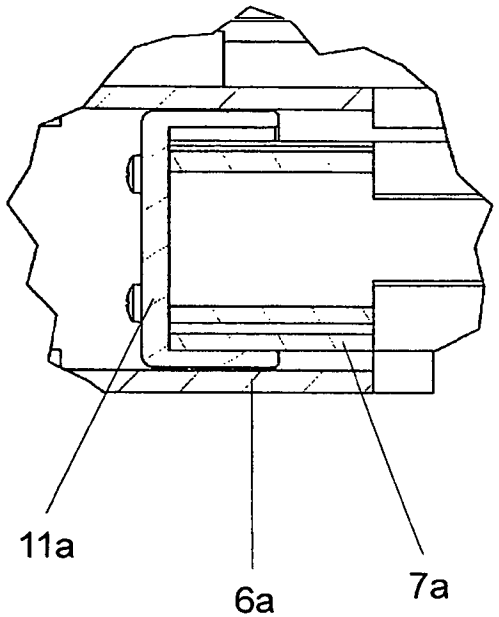

FIG. 12 a detailed view of an end of an extension arm received in a guide rail attached to the machine table in which a guide groove for the rip fence module is provided according to the preceding figures;

FIG. 13 a detailed view of an end of the guide rails receiving the extension arms facing towards the rip fence module; and FIG. 14 a detailed sectional view alongside line XIV-XIV in FIG. 2 of one of the guide arms received in the guide rails on which the guide groove for the rip fence module is provided in the embodiment of the invention shown in the preceding figures.

At first reference is made to FIGS. 1 to 3, which show a machine table 3 of a circular saw designated with 1 onto which a table widening module and a rip fence module is attached on the side located in the extension direction A. On the machine table 3 a tool slot 2 is provided through which a disk of the circular saw can pass, with an extension plate 8 of the table widening module being attached on the one side of the tool slot 2, and a mitre fence module 4 being attached on the other side of the workpiece tool 2. The table widening module is designed such that the machine can easily be reconfigured by attaching the extension element on the other table side.

For this purpose, alongside the machine table 2 in front and at the back on the external end of the table a guide rail 6*a*, 6*b* each is mounted in which two extension arms 7*a*, 7*b* are received in a guided manner among which the extension plate 8 is fixed flush on top with the upper side of the machine table 3. An extension element of the table widening module thus comprises apart from the extension plate 8 also the two extension arms 7*a*, 7*b* and must not be dismantled before being reinserted into the guide rails 6*a*, 6*b* on the other side of the table.

The guide rails 6*a*, 6*b* are penetrated here by a guide groove each 6*a*, 12*a* and/or 6*b*, 12*b* over their entire length extending in extension direction A which is formed by the guide rail 6*a*, 6*b* itself and/or its internal cross-section, and a slide bush 12*a*, 12*b* each fitted on the part of the extension plate 8. The guide arms 7*a*, 7*b* are received in the respective guide groove 6*a*, 12*a* and 6*b*, 12*b* resp. in a guided manner, and have a constant cross-section, which is not undercut, over their entire length.

A sliding cap each 11*a*—and/or on the opposite side not shown here—11*b* is screwed onto its end received in the respective guide groove 6*a*, 12*a* and 6*b*, 12*b* resp.

The ends of the guide arms 7*a*, 7*b* provided with one of the sliding caps 11*a*, 11*b* each can be taken in detail from FIG. 12. One can see that the sliding caps 11*a*, 11*b* slide off on the inner surface of the respective guide rails 6*a*, 6*b* into the respective guide groove 6*a*, 12*a* and 6*b*, 11*b* resp.

The ends of the guide rails 6*a*, 6*b* provided with the slide bushes 12*a* and 12*b* resp. facing towards the extension plate 8, however, are shown in detail in FIGS. 13 and 14. One can see that the slide bushes 12*a*, 12*b* are fitted into and/or onto the guide rails 6*a* and/or 6*b* from the side. For this purpose, slide bushes 12*a*, 12*b* each comprise a screw-in guide groove 19 by means of which they can be fitted onto fastening bolts 18 provided on the guide rail 6*a*. The sliding caps 12 need only be turned for fastening or removal.

Reference numeral 10 in FIG. 1 moreover designates a locking device of the table widening module by means of which the extension element can be fastened in a desired position via locking blocks 10*f* received in locking grooves 17*a* in the extension arms 6*a*, 6*b* which can be taken from FIG. 14. FIG. 14 also shows a rip fence shifting groove 14*a* in the extension arm 7*a*, which due to the identity of parts of the extension arms 7*a*, 7*b*, corresponds to an equal groove 14*b* in another extension arm 7*b* on the rear side of the machine table.

The rip fence module is thus received shiftably independent of the extension position of the extension element in the rip fence shifting groove 14*a* and the corresponding groove 14*b* on the extension arms 7*a*, 7*b*. Moreover, on the two extension arms 7*a*, 7*b* an end cap is screwed onto the end on the side of the rip fence (in the drawing only the end cap 13*b* provided on the rear extension arm 7*b* is shown) serving as a retaining stop for the rip fence module.

Moreover, the two extension arms 7*a*, 7*b* each are provided with another top holding groove 15*a* into which, for example, a sheet metal plate with a plotted longitudinal scale can be received or glued in. FIG. 2 also shows a window 15*b* through which a user can view a width scale on the guide rail 6*a* when using the rip fence in the case of non-extended table widening. If the user wants to use the rip fence in the case of extended table widening, at first the rip fence must be moved against the end cap 13*b*. The measure can then be read by means of scale pointer attached on the end of the extension arm 6*a* and/or the sliding cap 11*a* in the guide rail 7*a* on another scale attached on the guide rail 7*a*. In both cases it can be seen how far a workpiece stop of the rip fence formed by an angle bar 9*d* is away from the tool and/or the tool slot 2.

The rip fence module comprises a superstructure generally designated with 9 by means of which it overlaps the machine table 3 in longitudinal direction L. The superstructure 9 comprises a front frame 9*a* as well as a rear frame 9*c* among which a carrier section is screwed on. On the carrier section 9*b* the angle bar 9*d* is shiftably received in the longitudinal direction L via a clamping device 17.

The angle bar clamping device designated with 17 in FIGS. 1 and 2 is shown in detail in FIG. 3 with the angle bar 9*d* not being shown. The carrier section 9*b* is penetrated by clamping screw 17*b* at one end of which a hand-wheel 17*a* is attached whereas the other end of the clamping screw 17*b* is screwed into a contact pressure strip 17*c* insertable into an undercut groove of the angle bar 9*d*. Around the clamping screw 17*b* a bias spring 17*d* is placed keeping the contact pressure strip always at a distance so that it is easier to move the angle bar 9*d* forming the workpiece stop to the contact pressure strip 17*c*. In addition, the contact pressure strip 17*c* via the guide bolts 17*e* passing through the undercut groove is secured against tilting on both sides of the clamping screw likewise passing through the undercut groove, and is guided in allocated bores on the carrier section 9*b*.

As is particularly shown in FIG. 4, the locking device generally designated in FIGS. 1, 2 with 16 for locking the rip fence module in the guide grooves 14*a*, 14*b* of the two extension arms 7*a*, 7*b* comprises an adjusting lever 16*a*, on which via a tension rod tie bolt 16*f* a tension rod 16*b* passing through the portal-shaped superstructure 9 is received. On the tension rod 16*b* end opposite the adjusting lever 16*a* a clamping spigot 16*c* is fastened to the tension rod 16*b* via a bolt not referred to in detail. The clamping spigot 16*c* is suspended on the rear frame 9*c* of the portal superstructure 9 via a hinge axis 16*d* which is fastened via a hinged band clamp 16*e* on the rear frame 9*c*. As can especially be seen in FIG. 8, the tension lever 16*a* abuts the allocated bearing surface 9*e* on the front frame 9*a* of the superstructure 9 with an external perimeter surface 16*h* and is preloaded against the bearing surface 9*e* via the tension rod 16*b* and/or a tension rod bias spring placed around the tension rod 16*b*.

The tension rod tie bolt 16*f* via which the tension rod 16*b* is fastened to the pivoted lever 16*a* is received in a receiving bore 16*k* for the tension rod tie bolt 16*f* extending in extension direction A. The receiving bore 16*k* penetrates the pivoted lever 16*a* at a location eccentric to its pivot axis. On the other end, the tension rod 16*b* is fastened below the pivot point of the clamping spigot 16*c* on the rear frame 9*c* on the clamping spigot 16*c*. The clamping spigot 16*c* has a lug by means of which it can be braced against bearing surfaces and/or edges on the undercut groove 14*b* in the extension arm 7*b* on the side of the machine table 3 facing away from the operator, if via the tension rod 16*b* a traction is exercised on the clamping spigot 16*c* acting against the longitudinal direction L. In FIGS. 4 and 8 the clamping spigot 16*c* is in a position abutting against the bearing surfaces on the undercut groove 14*b*, hence in a locked position. For releasing the clamping spigot 16*c* from this position, the pivoted lever 16*c* must be pivoted upwards so that the eccentrically received tension rod tie bolt 16*f* in FIGS. 4 and 8 moves towards the right, hence in longitudinal direction L and thus a corresponding pressure is exercised on the clamping spigot 16*c* via the tension rod 16*b*. For locking the rip fence module again in the guide grooves 14*a*, 14*b* of the extension arms 7*a*, 7*b*, the pivoted lever 16*a* can be pressed downward again.

But via the pivoted lever 16*a* not only the clamping spigot 16*c* can be pivoted from a locking position into a release position and back, which is located on rear side of the machine table but also a locking (and/or release) of the rip fence module can be effected on a guided portion 24, 16*g* received in the rip fence shifting groove 14*a* on the front side. At the front, one does not only hold up against the clamping force of the clamping spigot (which would, however, be imaginable) but also an independent locking device locking (and releasing) the rip fence module in the front guide rail 14*a* is operated alone. Thus, the rip fence module can on the one hand be clamped onto the two extension arms 6*a*, 6*b* and thus locked via the clamping spigot 16*c* at the back and via an allocated counter-retaining device in front described below. In addition, the rip fence module can be braced on the front extension arm 6*a* via the locking on the guided portion 24, 16*g* at the front received in the rip fence shifting groove 14*a*. In total, a very small angle error of bracing results.

For detailed explanation of the use of this portion 24, 16*g* formed from a guided carriage generally designated with 24 and a contact pressure strip 16*g*, and guided in the rip fence shifting groove 14*a*, reference is now made to FIG. 5 which shows the detail designated with V in FIG. 4.

The guided carriage 24 comprises a ball bearing 24*a* abutting an upper, horizontal bearing surface of the rip fence shifting groove and a ball bearing 24*b* not visible in FIG. 5 abutting the opposite lower horizontal bearing surface of the rip fence shifting groove 14*a* (roll-off position; in the withdrawal position for withdrawal of the rip fence module from the machine table none of the two ball bearings 24*a*, 24*b* abuts any one of the bearing surfaces). The ball bearings 24*a*, 24*b* are pressed onto allocated bearing bolts 24*d*, 24*e*, which on one end are fastened to a rocker 24*c* shown especially in FIGS. 6 and 7, and on the other end are provided with a contact pressure strip 16*g* and spaced from the ball bearings 24*a*, 24*b* via stacks of spacer disks 24*i*, 24*j*. The rocker 24*c* and the bearing bolts 24*d*, 24*e* pressed onto it on both ends form an arm arrangement 24*c*, 24*d*, 24*e* spreadable and/or pivotable via a coupling pin 25*a* against the horizontal bearing surfaces on the rip fence shifting groove 14*a*, with the rocker 24 being non-rotatably connected with the coupling pin 25*a* via a locking pin 24*k*.

The coupling pin 25*a* passes through a carriage body 24*f* definable on the superstructure 9 and an adjusting lever 23 with the guide bolt 25*a* being connected via a tongue and groove joint in an eye section 23*a* of the adjusting lever 23 with the adjusting lever 23. In order to move the coupling pin 25*a*—and hence the arm arrangement 24*c*, 24*d*, 24*e* attached to it—towards and/or in an opposite direction to the longitudinal direction L, a coupling device generally designated with 25 in FIG. 4 is provided, which apart from the coupling pin 25*a* comprises a coupling section 25*b*, 25*c*, 25*d* on the rear side facing away from the rip fence shifting groove via which the coupling pin 25*a* can be shifted in longitudinal direction L.

The coupling section 25*b*, 25*c*, 25*d* on the rear side is coupled to the pivoted lever 16*a* of the locking device 16 so that via this pivoted lever 16*a* not only the clamping spigot 16*c* can be pivoted between its locking position and its release position, but also the coupling pin 25*a* and thus the contact pressure strip 16*g* attached to the coupling pin 25*a* can be brought from its locking position abutting against the rear side of the undercut of the guide groove 14*a* into a release position detached from the rear side of the undercut (and back). In the locking position the contact pressure strip 16*g* bears against the undercut of the guide groove 14*a* from the inside and at the same time also the lateral surface of the carriage body 24*f* facing the extension arm 7*a* (and thus facing the contact pressure strip 16*g*) as a counter-retaining surface from the outside against a corresponding bearing surface of the extension arm 7*a*.

The pivoted lever 16*a* comprises a guide groove 16*i* extending spirally around its pivot axis in which a guide pin 16*j* is received onto which—see FIGS. 8, 9—a forked sleeve 25*b* is suspended. The forked sleeve 25*b* comprises arms encompassing the coupling pin 25*a* onto which it is suspended on the guide pin 16*j*. The forked sleeve 25*b* is received vertically shiftable here between a surface of the adjusting lever 23 extending vertically and a washer 25*c*.

The forked sleeve 25*b* and the allocated washer 25*c* are shown in detail in FIGS. 10 and 11. One can see that on the forked sleeve 25*b* two arched coupling projections 25 towards the washer 25*c* are provided to which a coupling groove 25*g* each is allocated provided on the surface of the washer 25*c* facing towards the forked sleeve 25*b*. As can be seen in FIG. 8, the coupling grooves 25*g* start on the upper end of the washer 25*c* and end with a rounded flank in an area in which there are the coupling projections 25*h* shortly before by pressing down the pivoted lever 16*a* (arrow "Off") the clamping bar 16*g* is put against the undercut of the guide rail 14*a*.

If the pivoted lever 16*a* is now pressed down further, the coupling projections 25*h* bear against the flanks of the coupling grooves 25*g* on the underside thus causing a shifting of the washer 25*c* in an opposite direction to the longitudinal direction L, hence towards the operator. The washer 25*c* is penetrated by the coupling pin 25*a* here in a center bore 25*f* and screwed together with the coupling pin 25*a* via a coupling adjustment screw 25*d* so that when actuating the pivoted lever 16*a* together with the washer 25*c* also the coupling pin 25*a* and thus finally the contact pressure strip 16*g* is shifted towards the operator.

The coupling projections 25*h* are abutting the flanks on the underside of the coupling grooves 25*g* and are thus in an intermediate position between the release position and the locking position with the contact pressure strip 16*g* being drawn against the undercut 14*a* of the guide groove in the extension arm 7*a* and aligned rectangularly.

If the pivoted lever 16*a* is still pressed down a few degrees further, the intermediate position is passed over and the coupling projections 25*h* emerge from the coupling grooves 25*g*. This results in the actual locking (locking position) in which the extension arm 7*a* is really tensioned tightly between the clamping bar 16*g* and the side of the carriage body 24*f* facing towards the clamping bar 16*g*.

Preferably the length and position of the coupling grooves 25*g* are adjusted to the drive line 16*f*, 16*b*, 16*d* for the rear clamping spigot 16*c* such that the contact pressure strip 16*g* is pressed against the undercut 14*a* of the guide groove in the extension arm 7*a* before actual locking via the tension lever 16*a* occurs.

In the release position the adjusting lever 23 is therefore not under tension between the carriage body 24*f* and the coupling arrangement 25*b*, 25*c* on the rear side formed by the forked sleeve 25*b* and the washer 25*c* so that the rocker 24*c* can be moved via a twisting of the adjusting lever 23. In the locking position, however, the adjusting lever 23 is gripped between the carriage body 24*f* and the coupling arrangement 25*b*, 25*c* on the rear side so that a spreading and/or horizontal position of the rocker 24*c* and/or the arm arrangement 24*c*, 24*d*, 24*e* formed from the rocker 24*c* and the bearing bolts 24*d*, 24*e*, at any rate, cannot be made unintentionally in this position.

In order to preload the rocker 24*c* into the release position, moreover a coupling bias spring 25*e* is provided placed around the coupling pin 25*a* which on the one hand is supported on the rocker 24*c* and on the other hand is supported on the carriage body 24*f* (FIG. 6). Moreover, the carriage body 24*f* on the side facing towards the rocker 24*c* comprises an annular projection 24*g* surrounding the perimeter of the coupling bias spring 25*e*, and can be retracted into an allocated recess in the rocker. Via the screw-in depth of the coupling adjustment screw 25*d* thus the distance between the carriage body 24*f* and the contact pressure strip 16*g* can be adjusted in the release position.

Moreover, a bias spring 24*l* for the rocker 24*c* is provided, via which the rocker 24*c* is preloaded into a spread position, i.e., a position in which the ball bearings 24*a*, 24*b* abut the bearing surfaces of the rip fence shifting groove 14*a* provided for it (FIG. 7). The bias spring 24*l* is placed on a bias spring removal screw 24*m*, which is screwed into the carriage body 24*f* from the bottom with vertical screw axis, and on the other hand supported in a recess of the rocker 24*c* provided for it adjacent to the bearing 24*a*. On the other side of the rocker 24*c* adjacent to the bearing 24*b* moreover an adjusting screw with vertical screw axis is screwed into the carriage body 24*f* from the bottom acting as an adjustable attachment point. Via the pretensioning force set screw 24*m* a pretensioning force can be adjusted here by means of which the bias spring 24*l* preloads the rocker 24*c* into the spread position.

Finally, reference is made again to FIG. 4 in order to emphasise that the rip fence module of the embodiment shown can be braced and/or locked in the grooves 14*a*, 14*b* provided for it in the extension arms 7*a*, 7*b* on both sides of the machine table and/or the extension plate 8 attached to it. But in the release position the rip fence module is only guided via ball bearings 24*a*, 24*b* in the front rip fence shifting groove 14*a* facing towards the operator but not in the groove 14*b* on the rear side. Depending on the position on the table top 3 and the extension plate 8 resp., the rip fence module in its rear side area rather bears on the surface of the machine table 3 and/or the extension plate 8 slidingly supported by a slide bush 26. But it is also imaginable to provide a roller or the like instead of the slide bush 26.

The guide rails 6*a*, 6*b* are fastened to the machine table 3 by means of screw connections (not shown) whereas the extension arms 6*a*, 6*b* are fastened to the extension plate 8 by means of fastening bolts 27 (FIG. 6).

It is obvious that variations and modifications of the embodiment shown are possible without abandoning the scope of the invention.

REFERENCE NUMERALS

A extension direction
L longitudinal direction
1 circular saw (machine tool)
2 workpiece slot
3 machine table
4 mitre fence module
6*a*, 12*a*, 6*b*, 12*b* guide grooves (guided portion)
6*a*, 6*b* guide rails
7*a*, 11*a*, 7*b*, 11*b* sliding portion
7*a*, 7*b* extension arms
8 extension plate
9 portal superstructure
9*a* front frame
9*b* carrier section
9*c* rear frame
9*d* angle bar
9*e* eccentric clamping surface
10 locking device of the table widening
10*f* locking block of the table widening
11*a*, 11*b* sliding caps (covering)
12*a*, 12*b* sliding caps (lining)
13*b* end cap
14*a* rip fence shifting groove
14*b* rear side groove
15*a* holding groove for width scale
15*b* window
16 locking device
16*a* pivoted lever
16*b* tension rod
16*c* clamping spigot
16*d* hinge axis
16*e* hinged band clamp
16*f* tension rod tie bolt
16*g* contact pressure strip
16*h* external perimeter bearing surface
16*i*, 16*k* eccentric guided portions
16*i* forked sleeve guide groove
16*j* forked sleeve guide pin
16*k* tension rod tie bolt receiving bore
16*l* tension rod bias spring
17 angle bar clamping device
17*a* handle
17*b* clamping screw
17*c* contact pressure
17*d* bias spring
17*e* guide bolt
18 slide bush fastening bolt
19 screw-in guide grooves
21 undercut groove

22 stop surface
23 bearing clearance adjusting lever
23*a* eye section
24 guided carriage (guided portion)
24*a*, 24*b* roller bearings
24*c* rocker
24*d*, 24*e* bearing bolt
24*f* carriage body
24*g* annular projection
24*h* coupling pin
24*i*, 24*j* spacer disk stacks
24*k* locking pin for coupling pin
24*l* bias spring for rocker (preloading device for arm arrangement)
24*m* pretensioning force set screw
25 coupling device
25*a* coupling pin
25*b*, 25*c*, 25*d* coupling section on rear side
25*b* forked sleeve
25*c* washer
25*d* coupling adjustment screw
25*e* coupling bias spring
25*f* bore of pad
25*g* coupling grooves
25*h* coupling projections
25*i* pin receiving openings
26 slide bush
27 fastening bolt

The invention claimed is:

1. A rip fence module for a machine tool (1), in order to position workpieces with their edge facing away from a tool (2) on a machine table (3) at a certain distance to the tool (2), comprising:

a superstructure (9) overlapping the machine table (3) at least in sections presenting a workpiece stop (9*d*) for the workpiece to be treated extending in a longitudinal direction (L);

only one guided portion (24, 16*g*) which is insertable and guidable in an allocated guide groove (14*a*) provided on a machine table side extending in an extension direction (A) transversely to the longitudinal direction (L), and by which the superstructure (9) is supported movably in the guide groove (14*a*) in the extension direction (A) in relation to the tool (2); and a locking device (16) shiftable between a locking position and a release position in order to lock the rip fence module in the locking position with the guided portion (24, 16*g*) defined in relation to the guide groove (14*a*), and to permit in the release position a shifting of the guided portion (24, 16*g*) in the guide groove (14*a*), wherein:

the guided portion (24, 16*g*) comprises a guided carriage (24) insertable in the guide groove (14*a*) at least in sections which guided carriage (24) in turn comprises a number of ball bearings or roller bearings (24*a*, 24*b*) by means of which the guided carriage (24) inserted into the guide groove (14*a*) is movable on rollers in the release position on allocated roll-way surfaces of the guide groove (14*a*);

with the guided carriage (24) comprising a carriage body (24*f*) fixed at the superstructure (9) on which carriage body (24*f*) each of the number of ball bearings or roller bearings (24*a*, 24*b*) is received via a movable arm arrangement (24*c*, 24*d*, 24*e*) with a distance being alterable to the respectively allocated roll-way surface in a vertical direction between a roll-off position, in which each of the number of ball bearings or roller bearings (24*a*, 24*b*) abuts said roll-way surface in the guide groove (14*a*), and a non-abutting withdrawal position for withdrawal of the guided carriage (24) inserted into the guide groove (14*a*) from the guide groove (14*a*); wherein the arm arrangement (24*c*, 24*d*, 24*e*) comprises a rocker (24*c*) attached pivotably on the carriage body (24*f*), with two bearing bolts (24*d*, 24*e*) attached on two opposite sides of the rocker (24*c*), with at least one ball bearing or roller bearing (24*a*, 24*b*) being received on each of the bearing bolts (24*d*24*e*).

2. A rip fence module according to claim 1, wherein:

a preloading device (24*l*) being provided by means of which the arm arrangement (24*c*, 24*d*, 24*e*) is preloaded into the roll-off position in which the ball bearings or roller bearings (24*a*, 24*b*) are spread against the allocated roll-way surfaces in the guide groove (14*a*).

3. A rip fence module according to claim 1, characterised in that the locking device (16) comprises a contact pressure strip (16*g*) receivable in the respective guide groove (14*a*) with the contact pressure strip (16*g*) being shiftable via a coupling device (25) engaged in longitudinal direction (L) into the guide groove (14*a*) in relation to the carriage body (24*f*) in longitudinal direction (L) between the locking position, in which it bears against a rear side of an undercut of the guide groove (14*a*) extending in extension direction, and the release position, in which it is detached from the rear side of the undercut.

4. A rip fence module according to claim 3, characterised in that the carriage body (24*f*) in its section facing towards the contact pressure strip (16*g*) comprises a counter-retaining surface for a bearing surface on a front side of the undercut so that the counter-retaining surface in the locking position abuts the bearing surface and does not abut the bearing surface in the release position.

5. A rip fence module according to claim 1, characterised in that for manual modification of the distance of each ball bearing or roller bearing (24*a*, 24*b*) to the corresponding allocated roll-way surface on the guide groove (14*a*) an adjusting lever (23) is provided which is preferably coupled via the coupling device (25) with the arm arrangement (24*c*, 24*d*, 24*e*) such that the arm arrangement (24*c*, 24*d*, 24*e*) at least in the release position of the locking device (16) is movable between the withdrawal position and the rollable position.

6. A rip fence module according to claim 1, wherein:

the coupling device (25) comprises a coupling pin (25*a*) extending in longitudinal direction (L) and being received rotatably in the carriage body (24*f*), on the side of which facing towards the guide groove (14*a*) on the one hand the arm arrangement (24*c*) is received pivotably and on which on the other hand the contact pressure strip (16*g*) is fastened on the free ends of the bearing bolts (24*d*, 24*e*).

7. A rip fence module according to claim 6, wherein:

the adjusting lever (23) comprises an eye section (23*a*) penetrated by the coupling pin (25*a*) and connected non-rotatably with the coupling pin (24*h*), connecting with the eye section (23*a*) to the carriage body (24*f*) on the side facing the rocker (24*c*), and on the side of the eye section (23a) facing away from the rocker (24*c*) a coupling section (25*b*, 25*c*, 25*d*) on the rear side coupling the coupling pin (25*a*) with an operating device (16*a*) of the locking device (16) is provided, by means of which the coupling pin (25*a*) and thus the contact pressure strip (16*g*) is movable between the locking position and release position.

8. A rip fence module according to claim 7, wherein:

the rear coupling section (25*b*, 25*c*, 25*d*) comprises a pusher sleeve (25*b*) received in vertical direction on the operating device (16*a*) in a guided manner encompassing the coupling pin (25*a*) on its sides located in the pull out direction (A) and opposite to this direction (A), as well as a washer (25*c*) fastened to the coupling pin (25*a*) on the side of the pusher sleeve (25*b*) facing away from the adjusting lever (23), with at least one coupling projection (25*h*) being provided on the pusher sleeve (25*b*) oriented towards the washer (25*c*), and on the washer (25*c*) for each coupling projection (25*h*) a coupling control groove (25*g*) facing towards it and extending in vertical direction, with the coupling control groove (25*g*) comprising on the underside an ascending end with a rounded or angled flank abutting the coupling projection (25*h*) in the intermediate position, and which is passed over, if the operating device (16*a*) of the clamping device (16) is put from the release position into the locking position by an operator.

9. A rip fence module according to claim 8, wherein:

between the carriage body (24*f*) and rocker (24*c*) a coupling bias spring (25*e*) is provided preloading the rocker (24*c*) in the direction of the release position, with maximum deflection of the coupling bias spring (25*e*) being adjustable by means of a coupling adjustment screw (25*d*) by means of which the washer (25*c*) penetrated by the coupling pin (25*a*) is fastened on the coupling pin (25*a*) on the side of the pusher sleeve (25*b*) facing away from the adjusting lever (23).

10. A rip fence module according to any one of the preceding claims, characterised in that as an operating device (16*a*) of the locking device (16) a pivoted lever (16*a*) is provided, which is received pivotably on the superstructure (9) between the release position and the locking position around a pivot axis extending in the extension direction (A), with the pivoted lever (16*a*) comprising at least a guided portion (16*i*, 16*k*) extending eccentrically to its pivot axis by means of which the locking device (16) is shiftable, and preferably the coupling device (25) is coupled with the pivoted lever (16*a*).

11. A rip fence module according to claim 10, characterised in that the pivoted lever (16*a*) comprises as an eccentric guided portion (16*i*) a guide groove (16*i*) extending eccentrically to its pivot axis, into which the pusher sleeve (25*b*) is received with a guide pin (16*j*) connecting at the top its arms encompassing the coupling pin (25*a*) so that the pusher sleeve (25*b*) can be actuated in vertical direction by the pivoted lever (16*a*).

12. A rip fence module according to claim 1, characterised in that the superstructure (9) is formed as a portal superstructure (9) entirely overlapping the machine table (3) in longitudinal direction (L), with the locking device (16) on the rear side of the machine table (3) facing away from the operator comprising a tension rod (16*b*) passing through the portal superstructure (9) in longitudinal direction (L) with the clamping spigot (16*c*) coupled to the operating device (16*a*) provided on the front side of the superstructure, and the clamping spigot (16*c*) by means of the operating device (16*a*) and the tension rod (16*b*) can be pressed into an allocated guide groove (14*b*) provided on the machine table side (locking position) and can be put into the release position movable transversely to the longitudinal direction (L).

13. A rip fence module according to claim 12, characterised in that the pivoted lever (16*a*), as an eccentric guided portion (16*k*), comprises, in a point located eccentrically to its pivot axis, a holding groove (16*i*), extending in parallel to the pivot axis, for a tension rod tie bolt (16*f*) in which holding groove the tension rod (16*b*) is received by means of the tension rod tie bolt (16*f*) fastened to it, and the clamping spigot (16*c*) is suspended rotatably on a hinge axis (16*d*) on the superstructure (9) extending in extension direction (A) with the tension rod (16*b*) engaging on the clamping spigot (16*c*) below the hinge axis (16*d*) so that the clamping spigot (16*c*) can be pivoted around the hinge axis (16*d*) by means of the pivoted lever (16*a*).

14. A rip fence module according to claim 1 or 12, characterised in that the superstructure (9) comprises a carrier section (9*b*) fastened between a front frame (9*a*) and a rear frame (9*c*) against which carrier section an angle bar (9*d*) forming a workpiece stop can be clamped by means of an angle bar clamping device (17) and can be released for shifting in longitudinal direction (L).

15. A rip fence module according to claim 14, characterised in that the angle bar (9*d*) comprises an undercut groove extending in longitudinal direction (L) and the angle bar clamping device (17) a contact pressure strip (17*c*) received in the undercut groove as well as a clamping screw (17*b*) passing through the carrier section (9*b*) and screwed to the contact pressure strip (17*c*) with a bias spring (17*d*) by means of which the contact pressure strip (17*c*) is preloaded away from the carrier section (9*b*)

* * * * *